US005720418A

United States Patent [19]

Timmerman et al.

[11] Patent Number: 5,720,418

[45] Date of Patent: Feb. 24, 1998

[54] ADJUSTABLE TOOL FOR DISPENSING VISCOUS MATERIAL, SUCH AS TWO-PART ADHESIVE

[75] Inventors: Mark S. Timmerman, Elgin; Terry R. Walker, Bloomingdale; Richard J. Ernst, Palatine; Daniel L. Downey, St. Charles, all of Ill.

[73] Assignee: Illinois Tool Works Inc., Glenview, Ill.

[21] Appl. No.: 514,772

[22] Filed: Aug. 14, 1995

[51] Int. Cl.[6] ..... B67D 5/42

[52] U.S. Cl. ..... 222/309; 222/391

[58] Field of Search ..... 222/134, 137, 222/145.5, 145.6, 326, 327, 309, 391, 287, 324; 74/141.5

[56] References Cited

U.S. PATENT DOCUMENTS

| | | | |
|---|---|---|---|
| 2,367,346 | 1/1945 | Good | 222/391 |
| 4,840,294 | 6/1989 | Ernst | 222/287 |
| 5,020,693 | 6/1991 | Ernst et al. | 222/137 |
| 5,197,635 | 3/1993 | Chang | 222/391 |
| 5,390,831 | 2/1995 | Schneider | 222/137 |

*Primary Examiner*—Philippe Derakshani

*Attorney, Agent, or Firm*—Dressler, Rockey, Milnamow & Katz, Ltd.

[57] ABSTRACT

An adjustable tool is disclosed for dispensing a two-part adhesive from a two-chamber cartridge having a mixing nozzle with each chamber having a plunger. Pistons are insertable into the respective chambers. Piston rods and a drive rod move conjointly with the pistons. A lever is pivotable on the frame. A feed nut is mounted loosely on the drive rod so as to be capable of gripping the drive rod when canted for moving the feed nut, the drive rod, the piston rods, and the pistons conjointly to a forward limiting position of the feed nut when the lever is actuated. A spring biases the feed nut backwardly and permits the feed nut to be canted, to grip the drive rod, and to be moved forwardly and conjointly with the drive rod, the piston rods, and the pistons when the lever is pivoted into an actuated position. A set screw threaded adjustably into a threaded hole in the frame defines a backward limiting position of the feed nut. The screw head engages an outer margin of the threaded hole, in a counterbore, to provide an inner limit to threading of the set screw. A cover mounted over the threaded hole has an access hole sized to permit a screwdriver tip of a smaller size but not the screw head to pass and engages the screw head at an inner margin of the access hole so as to provide an outer limit to unthreading of the set screw.

4 Claims, 1 Drawing Sheet

ADJUSTABLE TOOL FOR DISPENSING VISCOUS MATERIAL, SUCH AS TWO-PART ADHESIVE

TECHNICAL FIELD OF THE INVENTION

This invention pertains to an adjustable tool for dispensing a viscous material, such as an adhesive, from a cartridge having a plunger in a chamber containing the viscous material. A set screw is adjustable to adjust the displacement of certain movable elements of the tool so as to accommodate the viscosity of the dispensed material.

BACKGROUND OF THE INVENTION

Conventionally, a viscous material such as a one-part adhesive or a caulking material is dispensed from a cartridge having a chamber containing the viscous material, having a nozzle to eject the viscous material, and having a plunger within the chamber to force the viscous material through the nozzle, via a manually actuatable tool comprising a lever-actuated piston, which drives the plunger through the chamber.

As a common variant, a two-part adhesive is dispensed from a cartridge having two chambers containing the respective parts of the two-part adhesive, having a mixing nozzle to mix the respective parts and to eject the mixed parts, and having plungers within the respective chambers to force the respective parts through the nozzle, via a similar tool.

A manually actuatable, adjustable tool for dispensing a two-part adhesive is disclosed in Ernst U.S. Pat. No. 4,840,294. As disclosed therein, mechanical advantage provided by a manually actuatable lever is adjustable to accommodate different viscosities, via a bolt having a threaded portion and having an end portion engaging a feed plate, which is arranged to grip a pushing rod when canted.

SUMMARY OF THE INVENTION

This invention provides an improved, adjustable tool for dispensing a viscous material from a cartridge having a chamber containing the viscous material. The cartridge has a distal end and a proximal end, a nozzle mounted to the distal end, and a plunger accessible from the proximal end and displaceable through the chamber, toward the nozzle, so as to force the viscous material into the nozzle, through which the viscous material is ejected.

The adjustable tool comprises a frame adapted to hold such a cartridge and a piston insertable forwardly into such a cartridge held by the frame, from the proximal end of the held cartridge, against the plunger of the held cartridge. The adjustable tool also comprises a piston rod mounting the piston, mounted movably to the frame, and arranged to move forwardly and backwardly and conjointly with the piston, a drive rod mounted movably to the frame and arranged to move forwardly and backwardly and conjointly with the piston and the piston rod, and a lever mounted to the frame so as to be pivotable between a deactuated position and an actuated position. The drive rod may be also called a plunger rod.

The adjustable tool further comprises means including a feed nut mounted loosely on the drive rod so as to be capable of being canted on the drive rod and of gripping the drive rod when canted for moving the feed nut, the drive rod, the piston rod, and the piston forwardly and conjointly over a displacement measured from a backward limiting position of the feed nut to a forward limiting position of the feed nut when the lever is pivoted from the deactuated position into the actuated position. The feed nut is movable backwardly from the forward limiting position, along the drive rod, toward the backward limiting position of the feed nut, when not canted so as to grip the drive rod, the forward limiting position corresponding to the actuated position of the lever.

The adjustable tool further comprises means for biasing the feed nut backwardly along the drive rod and for biasing the lever toward the deactuated position. The biasing means permits the feed nut to be canted on the drive rod, to grip the drive rod, and to be moved forwardly and conjointly with the drive rod, the piston rod, and the piston when the lever is pivoted from the deactuated position into the actuated position.

The adjustable tool further comprises means including a stop mounted to the frame for defining the backward limiting position of the feed nut. The stop is adjustable for adjusting the backward limiting position of the feed nut and the displacement of the feed nut, the drive rod, the piston rod, and the piston.

The adjustable tool also may comprise a handle extending fixedly from the frame, for limiting pivotal movement of the lever into the actuated position, to which the forward limiting position of the feed nut corresponds.

Preferably, the stop is a set screw having a threaded shank threaded into a threaded hole in the frame, the set screw having a screw head enabling the screw to be manually turned via a screwdriver, allen wrench, or other suitable tool. Preferably, moreover, the frame has a counterbore receiving the screw head and defining an outer margin around the threaded hole, the outer margin being arranged to engage the screw head so as to provide an inner limit to threading of the threaded shank into the threaded hole in the frame when the screw head reaches the outer margin.

Preferably, furthermore, the means for defining the backward limiting position of the feed nut comprises a cover mounted to the frame so as to cover comprises a cover mounted to the frame so as to cover the threaded hole in the frame except for an access hole in the cover. The access hole is sized to permit a screwdriver tip of a smaller size but not the screw head to pass through the access hole. The cover is arranged to engage the screw head at an outer margin around the access hole so as to provide an outer limit to unthreading of the threaded shank from the threaded hole in the frame.

This invention may be advantageously embodied in an adjustable tool for dispensing a two-part adhesive from a cartridge having two chambers containing the respective parts of the two-part adhesive. Such a cartridge has a distal end and a proximal end and a mixing nozzle mounted to the distal end. Each chamber of such a cartridge has a plunger accessible from the proximal end and displaceable through said chamber, toward the mixing nozzle, so as to force one part of the two-part adhesive into the mixing nozzle, through which the two-part adhesive is ejected.

If this invention is embodied in an adjustable tool for dispensing a two-part adhesive from such a cartridge having two chambers, the adjustable tool is similar except for comprising two pistons, one for each chamber of the cartridge, and two piston rods, one for each piston.

The displacement of the feed nut, the drive rod, the piston rod or piston rods, and the piston or pistons can be thus adjusted between the inner limit defined by the outer margin of the threaded hole and the outer limit defined by the inner margin of the access hole. Shorter displacements, which require a greater number of strokes to empty a given cartridge, are suitable for weaker users, for users dispensing more viscous materials, or for users working at colder temperatures. Longer displacements, which require a lesser number of strokes to empty the same cartridge, are suitable for stronger users, for users dispensing less viscous materials, or for users working at warmer temperatures.

These and other objects, features, and advantages of this invention are evident from the following description of a preferred embodiment of this invention with reference to the accompanying drawings.

DETAILED DESCRIPTION OF THE PREFERRED EMBODIMENT

Figure 1:
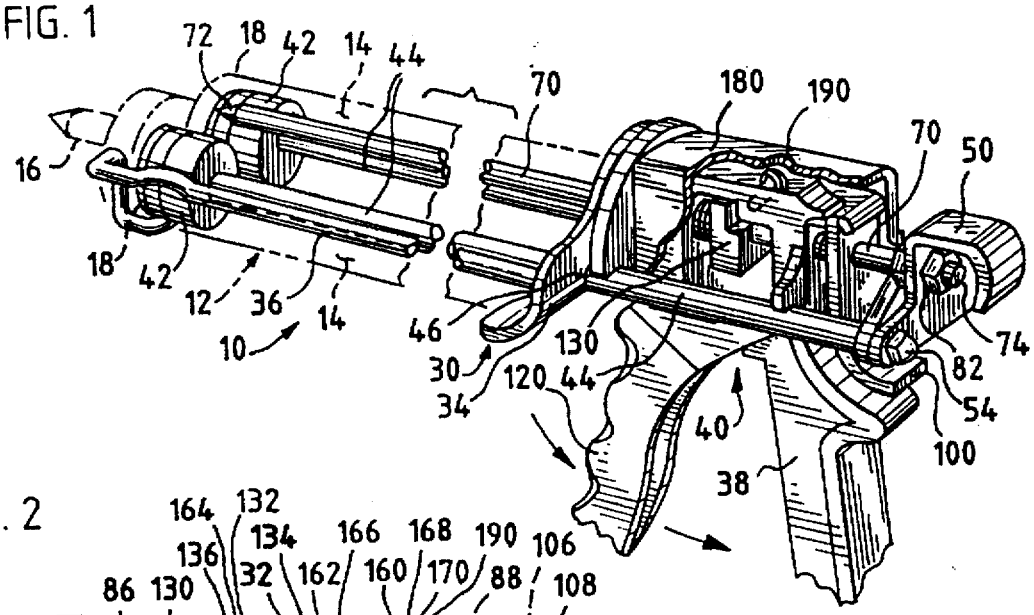
FIG. 1 is a perspective, partly fragmentary view of an adjustable tool constituting a preferred embodiment of this invention. A cartridge with two chambers containing the respective parts of a two-part adhesive and with a mixing nozzle is shown in broken lines.

As shown in the drawings, an adjustable tool 10 for dispensing a two-part adhesive from a cartridge 12 constitutes a preferred embodiment of this invention. Being of a known type, the cartridge 12 has two chambers 14 containing the respective parts of the two-part adhesive. The cartridge 12 has a distal end and a proximal end and has a mixing nozzle 16 mounted to the distal end. Each chamber 14 has a plunger 18 accessible from the proximal end and displaceable through such chamber 14, toward the mixing nozzle 16, so as to force one part of the two-part adhesive into the mixing nozzle 16, through which the two-part adhesive is ejected.

The cartridge 12 is similar to the cartridge disclosed in Ernst et al. U.S. Pat. No. 5,020,693. Such cartridges containing EPCON two-part epoxy adhesives are available commercially from ITW Ramset/Red head (a division of Illinois Tool Works Inc.) of Wood Dale, Ill.

As shown, the adjustable tool 10 comprises a steel frame 30, which is adapted to hold the cartridge 12. The frame 30 comprises a mounting block 32, a mounting plate 34, which is mounted rigidly to the mounting block 32 at a front face of the mounting block 32, and a wire bracket 36, which is mounted rigidly to the mounting plate 34 so as to extend forwardly from the mounting plate 34. The mounting plate 34 is adapted to support the cartridge 12 near its proximal end and the wire bracket 36 is adapted to support the cartridge 12 near its distal end. The adjustable tool 10 comprises a fixed handle 38, which is formed in one piece with the mounting block 32 so as to extend downwardly from the mounting block 32.

Figure 2:
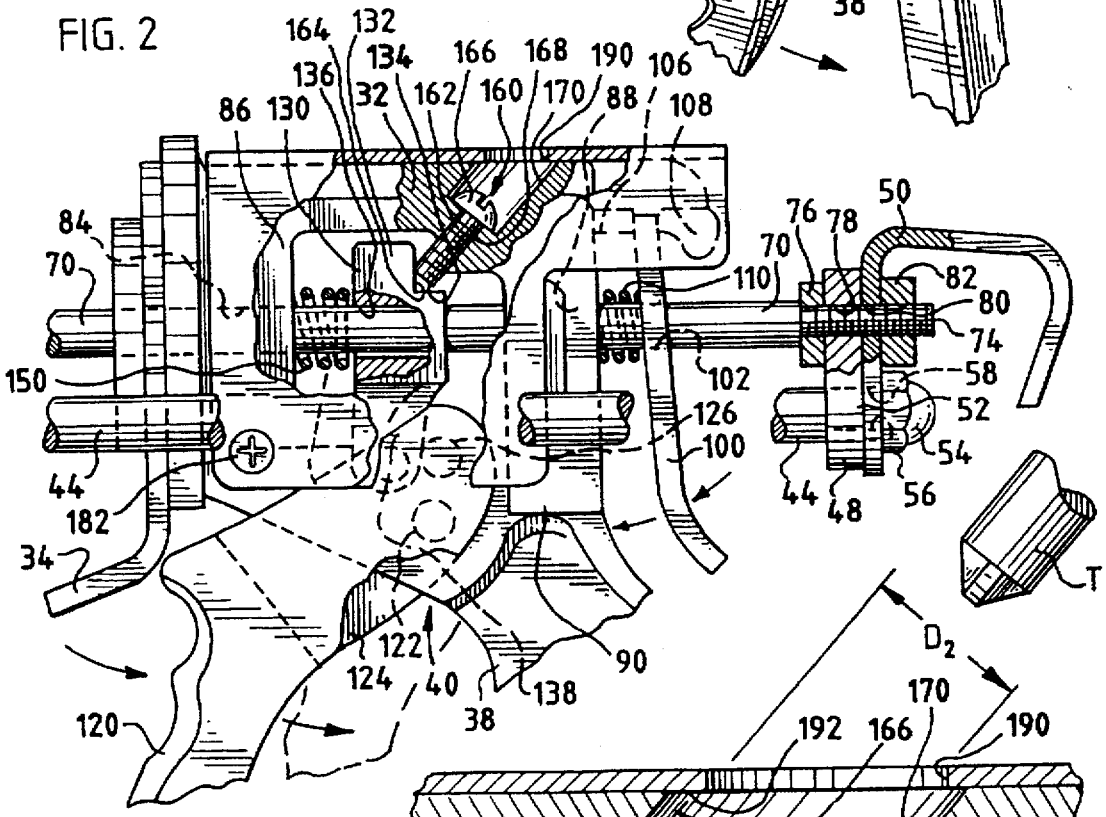
FIG. 2 is an enlarged, partly fragmentary detail of certain interactive elements of the adjustable tool.

Further, the adjustable tool 10 comprises an operating mechanism 40, which may be best seen in FIG. 2. The operating mechanism 40 comprises two pistons 42, one for each chamber 14 of the cartridge 12, and two piston rods 44, one for each piston 42. The pistons 42 are insertable and are inserted, as shown, into the respective chambers 14 of the cartridge 12, from the proximal end of the cartridge 12, against the plungers 18 of the respective chambers 14. The piston rods 44, which mount the respective pistons 42 at the distal ends of the piston rods 44, are mounted movably to the frame 30. The piston rods 44 are arranged to move forwardly and backwardly through apertures 46 in the mounting plate 34 and conjointly with the pistons 42. The piston rods 44 are connected to a back plate 48 and to a pull grip 50, at threaded portions 52 at the proximal ends of the piston rods 44, via cap nuts 54 threaded onto those portions 52, which extend through apertures 56 in the back plate 48 and through apertures 58 in the pull grip 50. The pull grip 50 is made from sheet steel and is shaped to permit a user to apply a backward pulling force on the pull grip 50 with one finger.

Further, the adjustable tool 10 comprises a drive rod 70, which has a chamfered tip 72 at its distal end and a threaded portion 74 at its proximal end. The threaded portion 74 receives a leading nut 76, extends through an aperture 78 in the back plate 48 and an aperture 80 in the pull grip 50, and receives a trailing nut 82 so as to be rigidly connected with the pistons 42 and with the piston rods 44, via the back plate 48 and the pull grip 50, and so as to be conjointly movable therewith. The drive rod 70, which may be also called a plunger rod, is arranged to move forwardly and backwardly through an aperture 84 in a front portion 86 of the mounting block 32 and through an aperture 88 in a back portion 90 of the mounting block 32.

A retaining lever 100 has an aperture 102, through which the drive rod 70 extends, behind the back portion 90 of the mounting block 32. The retaining lever 100 is held loosely at its upper end, between a front nub 106 on each side of the mounting block 32 and a back nub 108 on each side of the mounting block 32, so as to be pivotably movable between a gripping position and a releasing position. In FIG. 2, the retaining lever 100 is shown in the gripping position. If the retaining lever 100 were to be fully pivoted into the releasing position in broken lines, the retaining lever 100 would engage the fixed handle 38. In the gripping position, the retaining lever 100 grips the drive rod 70 so as to prevent the drive rod 70, the piston rods 44, and the pistons 42 from being moved backwardly. When pivoted from the gripping position toward the releasing position, the retaining lever 100 does not grip the drive rod 70 but permits the drive rod 70, the piston rods 44, and the pistons 42 to be forwardly or backwardly moved. A coiled spring 110 deployed around the drive rod 70, between the back portion 90 of the mounting block 32 and the retaining lever 100, biases the retaining lever 100 toward the gripping position but permits the retaining lever 100 to be manually pivoted from the gripping position toward the releasing position.

Because of friction between the drive rod 70 and the retaining lever 100, the retaining lever 100 tends to be sufficiently pivoted from the gripping position toward the releasing position as the drive rod 70 begins to be forwardly moved so as to release the drive rod 70 and to permit the drive rod 70, the piston rods 44, and the pistons 42 to be forwardly moved. The retaining lever 100 is arranged to be manually pivotable from the gripping position toward the releasing position so as to permit the drive rod 70, the piston rods 44, and the pistons 42 to be backwardly pulled via the pull grip 50, as when a cartridge like the cartridge 12 is to be loaded into the tool 10 or is to be unloaded from the tool 10.

The operating mechanism 40 also comprises an operating lever 120, which is mounted pivotably to the fixed handle 38 via a pivot pin 122 so as to be pivotable between a deactuated position and an actuated position. In FIG. 2, the operating lever 120 is shown in the deactuated position in full lines and in the actuated position in broken lines. The fixed handle 38 limits pivotal movement of the operating lever 120 into the actuated position. The operating lever 120 has an upper, bifurcated end 124, which carries the pivot pin 122 and a cross pin 126 spaced from the pivot pin 122.

The operating mechanism 40 further nut comprises a feed nut 130 having a wider, upper portion 132 with a recess 134 facing upwardly and backwardly and with a bore 136, through which the drive rod 70 passes loosely, whereby the feed nut 130 is mounted loosely on the drive rod 70 so as to be capable of being canted on the drive rod 70 and of gripping the drive rod 70 when canted. The feed nut 130 has a narrower, lower portion 138, which engages the cross pin 126 carried by the upper, bifurcated end 124 of the operating lever 120. When the feed nut 130 is canted so as to grip the drive rod 70 at the wider, upper portion 132, the feed nut 130, the drive rod 70, the piston rods 44, and the pistons 42 are movable forwardly and conjointly over a displacement measured from a backward limiting position of the feed nut 130 to a forward limiting position of the feed nut 130. The forward limiting position of the feed nut 130 corresponds to the actuated position of the operating lever 120.

The operating mechanism 40 further comprises a coiled spring 150, which is deployed around the drive rod 70, between the front portion 86 of the mounting block 32 and the feed nut 130, so as to bias the feed nut 130 backwardly along the drive rod 70, against the cross pin 126 carried by the upper, bifurcated end 124 of the operating lever 120, so as to bias the operating lever 120 toward the deactuated position. The coiled spring 150 permits the feed nut 130 to be canted on the drive rod 70, to be moved forwardly and conjointly with the drive rod 70, the piston rods 44, and the pistons 42 when the operating lever 120 is pivoted from the deactuated position into the actuated position. The coiled spring 150, when compressed fully, defines the forward limiting position of the feed nut 130.

Figure 3:
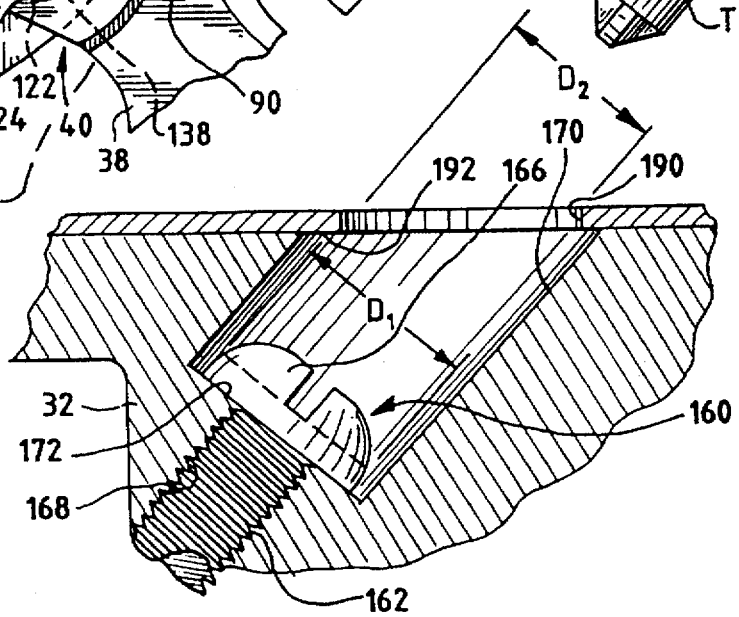
FIG. 3 is a further enlarged, partly fragmentary detail of a set screw providing an adjustable stop, along with certain associated elements of the adjustable tool.

The operating mechanism 40 further comprises a set screw 160 having a threaded shank 162, a blunt tip 164 on the threaded shank 162, and a screw head 166 for defining the backward limiting position of the feed nut 130 and for adjusting the backward limiting position of the feed nut 130 and the displacement of the feed nut 130, the drive rod 70, the piston rods 44, and the pistons 42. The threaded shank 162 is threaded adjustably into a threaded hole 168, which extends forwardly and downwardly through the mounting block 32 and opens outwardly at a counterbore 170 formed in the mounting block 168 and aligned with the threaded hole 168, so that the blunt tip 164 engages the feed nut 130 at the counterbore 134 to define the backward limiting position of the feed nut 130. As shown in FIG. 3, the screw head 166 is shaped to enable the set screw 160 to be manually turned for adjusting the threaded shank 162 in the threaded hole 168, via a screwdriver with a tip T shaped to engage the screw head 166. The threaded shank 162 can be thus threaded into the threaded hole 168 until the screw head 166 engages an outer margin 172 of the threaded hole 168, which margin 172 is defined by the counterbore 170, whereby the outer margin 172 provides an inner limit to threading of the threaded shank 162 into the threaded hole 168.

The adjustable tool 10 comprises a cover 180 made from sheet steel and mounted to the mounting block 32, via machine screws 182, so as to cover the counterbore 170 defining the outer margin 172 of the threaded hole 168 except for an access hole 190 in the cover 180. The access hole 190 is sized to permit a screwdriver tip T of a smaller size but not the screw head 166 to pass through the access hole 190. The diameter $D_1$ of the screw head 166 is larger than the diameter $D_2$ of the access hole 190. Thus, the cover 180 is arranged to engage the screw head 166 at an inner margin 192 of the access hole 190, where the inner margin 192 extends most forwardly, so as to provide an outer limit to unthreading of the threaded shank 162 from the threaded hole 168 in the mounting block 32.

The displacement of the feed nut 130, the drive rod 70, the piston rods 44, and the pistons 42 can be thus adjusted between the inner limit defined by the outer margin 172 of the threaded hole 168 and the outer limit defined by the inner margin 192 of the access hole 190. Shorter displacements, which require a greater number of strokes to empty a cartridge like the cartridge 12, are suitable for weaker users, for users dispensing more viscous materials, or for users working at colder temperatures. Longer displacements, which require a lesser number of strokes to empty a cartridge like the cartridge 12, are suitable for stronger users, for users dispensing less viscous materials, or for users working at warmer temperatures.

Although the preferred embodiment described above is intended for dispensing a two-part adhesive, such as a two-part epoxy, this invention may be also embodied in an adjustable tool intended for dispensing other viscous materials, such as one-part adhesives or caulking materials. Various other modifications may be made in the preferred embodiment described above without departing from the scope and spirit of this invention.

We claim:

1. An adjustable tool for dispensing a viscous material from a cartridge having a chamber containing the viscous material, the cartridge having a distal end and a proximal end and having a nozzle mounted to the distal end, the cartridge having a plunger accessible from the proximal end and displaceable through the chamber, toward the nozzle, so as to force the viscous material into the nozzle, through which the viscous material is ejected, the adjustable tool comprising:

a) a frame adapted to hold such a cartridge (b) a piston insertable forwardly into such a cartridge held by the frame, from the proximal end of the held cartridge, against the plunger or the held cartridge;

(d) a lever mounted to the frame so as to be pivotable between a deactuated position and an actuated position, (e) means including a feet nut mounted loosely on the rod so as to be capable of being canted on the rod and of gripping the rod when canted for moving the feed nut, the rod, and the piston forwardly and conjointly over a displacement measured from a backward limiting position of the feed nut to a forward limiting position of the feed nut when not canted so as to grip the road, the forward limiting position corresponding to the actuated position of the lever;

(f) means for biasing the feed nut backwardly along the rod and for biasing the lever mans permitting the feed nut to be canted on the rod, to grip the rod, and to be moved forwardly and conjointly with the rod and the piston when the lever is pivoted from the deactuated position onto the actuated position; and (g) means including a stop mounted to the frame for defining the backward limiting position of the feed nut, the stop being adjustable for adjusting the backward limiting position of the feed nut, the stop being adjustable for adjusting the backward limiting position of the feed nut and the displacement of the feed nut, the rod and the piston, wherein the stop is a set screw having a threaded shank threaded into a threaded hole in the frame, the set screw having a screw head enabling the screw to be manually turned via a screwdriver with a tip shaped to engage the screw head, wherein the frame has a counterbore receiving the screw head and defining an outer margin around the threaded hole, the outer margin being arranged to engage the screw head so as to provide an inner limit to threading of the threaded shank into the threaded hole in the frame when the screw head reaches the outer margin, and wherein the means for defining the backward limiting position of the feed nut comprises a cover mounted to the frame so as to cover the counterbore defining the outer margin of the threaded hole except for an access hole in the cover, the access hole being sized to permit a screwdriver tip of a smaller size but not the screw head to pass through the access hole, the cover being arranged to engage the screw head at an inner margin around the access hole so as to provide an outer limit to unthreading of the threaded shank from the threaded hole in the frame.

2. The adjustable tool of claim 1 further comprising a handle extending fixedly from the frame, the handle limiting pivotal movement of the lever into the actuated position, to which the forward limiting position of the feed nut corresponds.

3. An adjustable tool for dispensing a two-part adhesive from a cartridge having two chambers containing the respective parts of the two-part adhesive, the cartridge having a distal end and a proximal end and having a mixing nozzle mounted to the distal end, each chamber having a plunger accessible from the proximal end and having a mixing nozzle mounted to the distal end, each chamber having a plunger accessible from the proximal end and displaceable through said chamber, toward the mixing nozzle, so as to force one part of the two-part adhesive into the mixing nozzle, through which the two-part adhesive is ejected, the adjustable tool comprising:

(a) a frame adapted to hold such a cartridge;

(b) two pistons insertable forwardly into the respective chambers of such a cartridge held by the frame, from the proximal end of the held cartridge, against the plungers of the respective chambers of the held cartridge;

(c) two piston rods mounting the respective pistons, mounted movably to the frame, and arranged to move forwardly and backwardly and conjointly with the respective pistons;

(d) a drive rod mounted movably to the frame and arranged to move forwardly and backwardly and conjointly with the pistons and the piston rods;

(e) a lever mounted to the frame so as to be pivotable between a deactuated position and an actuated position, (f) means including a feed nut mounted loosely on the drive rod so as to be capable of being canted on the drive rod and of gripping the drive rod when canted for moving the feed nut, the drive rod, the piston rods, and the pistons forwardly and conjointly over a displacement from a backward limiting position of the feed nut to a forward limiting position of the feed nut when the lever is pivoted from the deactuated position into the actuated position, the feed nut being movable backwardly from the forward limiting position, along the drive rod, toward the backward limiting position of the feed nut, when not canted so as to grip the drive rod, the forward limiting position corresponding to the actuated position of the lever;

(g) means for biasing the feed nut backwardly along the drive rod and for biasing the lever toward the deactuated position, the biasing means permitting the feed nut to be canted on the drive rod, to grip the drive rod, and to be moved forwardly and conjointly with the drive rod, the piston rods, and the pistons when the lever is pivoted from the deactuated position into the actuated position; and (h) means including a stop mounted to the frame for defining the backward limiting position of the feed nut, the stop being adjustable for adjusting the backward limiting position of the feed nut and the displacement of the feed nut, the drive rod, the piston rod, and the piston, wherein the stop is a set screw having a threaded shank threaded into a threaded hole in the frame, the set screw having a screw head enabling the screw to be manually turned via a screwdriver with a tip engaging the screw head, wherein the frame has an outer margin around the threaded hole, the outer margin being arranged to engage the screw head so as to provide an inner limit to threading of the threaded shank into the threaded hole in the frame when the screw head reaches the outer margin, and wherein the means for defining the backward limiting position of the feed nut comprises a cover mounted to the frame so as to cover the counterbore defining the outer margin of the threaded hole in the frame except for an access hole in the cover, the access hole being sized to permit the tip of a screwdriver of a smaller size but not the screw head to pass through the access hole, the cover being arranged to engage the screw head at an inner margin of the access hole so as to provide an outer limit to unthreading of the threaded shank from the threaded hole in the frame.

4. The adjustable tool of claim 3 further comprising a handle extending fixedly from the frame, the handle limiting pivotal movement of the lever into the actuated position, to which the forward limiting position of the feed nut corresponds.

* * * * *

UNITED STATES PATENT AND TRADEMARK OFFICE

CERTIFICATE OF CORRECTION

PATENT NO. : 5,720,418

DATED : February 24, 1998

INVENTOR(S) : Timmerman et al.

It is certified that error appears in the above-indentified patent and that said Letters Patent is hereby corrected as shown below:

At column 6, line 51, "mans" should be --means--.

At column 6, lines 57 and 58, please delete the duplicate phrase "the stop being adjustable for adjusting the backward limiting position of the feed nut,".

Signed and Sealed this

Fifteenth Day of June, 1999

*Attest:*

Q. TODD DICKINSON

*Attesting Officer*

*Acting Commissioner of Patents and Trademarks*